United States Patent [19]

Garthaffner

[11] Patent Number: 4,593,705

[45] Date of Patent: Jun. 10, 1986

[54] SLITTER KNIFE ADVANCE UNIT AND METHOD OF USE

[75] Inventor: Martin T. Garthaffner, Midlothian, Va.

[73] Assignee: Philip Morris Inc., New York, N.Y.

[21] Appl. No.: 568,434

[22] Filed: Jan. 5, 1984

[51] Int. Cl.[4] ..... A24C 5/30

[52] U.S. Cl. ..... 131/84.4; 131/94; 83/169

[58] Field of Search ..... 83/169, 330; 131/94, 131/84 C

[56] References Cited

U.S. PATENT DOCUMENTS

| | | | |
|---|---|---|---|
| 3,847,044 | 11/1974 | Rudszinat | 83/169 |
| 4,028,973 | 6/1977 | Bogdanski | 83/169 |
| 4,090,424 | 5/1978 | Hall | 83/330 |

FOREIGN PATENT DOCUMENTS

| | | |
|---|---|---|
| 0900154 | 1/1959 | United Kingdom . |
| 0831576 | 3/1960 | United Kingdom . |
| 1525855 | 9/1978 | United Kingdom . |
| 2123324 | 2/1984 | United Kingdom . |

*Primary Examiner*—V. Millin

*Attorney, Agent, or Firm*—Wayne M. Kennard

[57] ABSTRACT

A method and apparatus are disclosed for severing or otherwise cutting cigarette filters, tobacco rods and the like. According to the invention, a slitter knife is maintained in whetting engagement with a whetting mechanism, so that the slitter knife never becomes dull. This is preferably achieved by mounting the slitter knife on a pivotable carriage and providing an automatic control system which pivots the slitter knife to maintain it in the desired engagement with the whetter. A feedback system can be included, to monitor the sharpness of the slitter knife and to indicate when adjustment of the slitter knife position is required.

13 Claims, 1 Drawing Figure

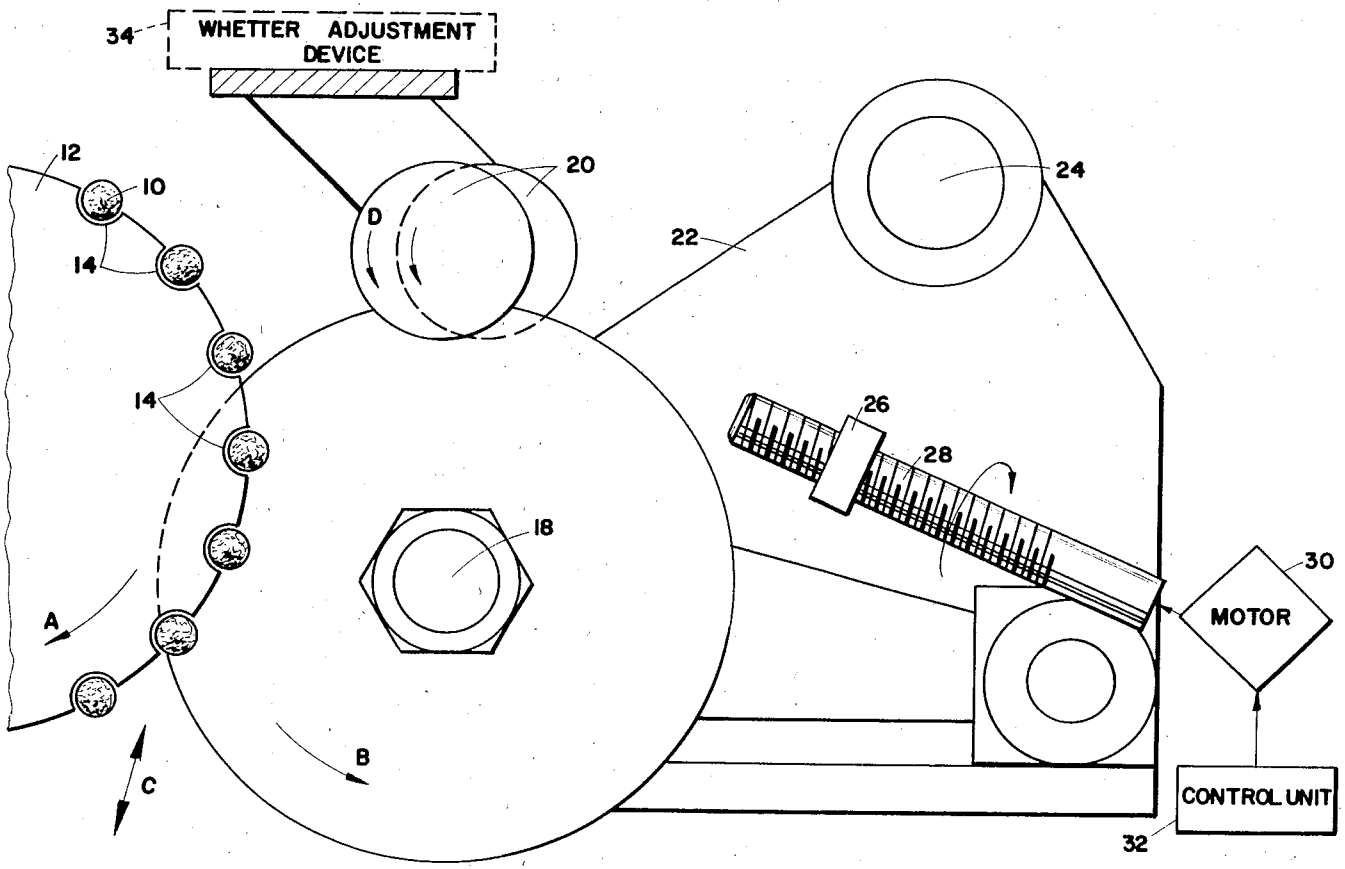
WHETTER ADJUSTMENT DEVICE
34
MOTOR
30
CONTROL UNIT
32
24
22
26
28
20
18
D
B
C
A
10
12
14
14

SLITTER KNIFE ADVANCE UNIT AND METHOD OF USE

The present invention pertains generally to the manufacture of cigarettes, and pertains more particularly to apparatus for cutting double length cigarette rods.

In the manufacture of filter cigarettes, it is not unusual to make double-length cigarettes (either filter cigarettes or filterless tobacco rods) and divide the double-length cigarettes by means of a rotating knife having the shape of a disc.

Similar knives are also used to form annular grooves in cigarette filters. In both applications, the disc becomes dull after a relatively short time. When this occurs, the quality of the cut suffers.

It is the object of the present invention to provide a slitter knife and associated apparatus adapted to maintain the knife sharp at all times, for optimum cutting, minimum down time and longer knife life.

The invention is a method and apparatus for cutting cigarettes and similar articles by means of a disc-shaped slitter knife. A whetting device is provided near the knife to whet the knife while the latter is cutting a workpiece. An adjustment device automatically varies the positions of the knife so that the knife engages the whetter more or less constantly.

Other features and objects of the invention will become clear from the following detailed description of the preferred embodiment, taken together with the accompanying figure, which is a side view of one preferred embodiment of the invention.

In the depicted embodiment, double-length cigarettes 10 are brought to the device of the invention for severing by means of a drum 12 formed with paraxial flutes or grooves 14 in its periphera1 surface and having conventional vacuum suction means provided to exert suction on objects placed in the grooves 14. The cigarettes 10 are deposited in a known manner in the grooves 14 and held there by the suction. The rotation of the drum 12 brings each double-length cigarette 10 in succession to the slitter knife 16 to be severed. The slitter knife 16 is mounted in a vertical plane for rotation about horizontal axis 18 and has one edge received in a peripheral slit provided for it in the drum 12. The slitter knife 16 is driven at high speed by a motor in a conventional fashion to sever each double-length ciqarette 10 as the latter is moved past the knife 16 by the drum 12.

Two whetter discs 20 are provided adjacent the slitter knife 16. It is conventional to use the whetters 20 to sharpen the slitter knife 16 only intermittently, whenever the operator notices that the knife 16 has dulled. According to the invention, however, the slitter knife 16 is maintained constantly in engagement with the whetters 20, whenever the slitter knife 16 is rotating. For this purpose, the slitter knife 16 is mounted at one corner of a generally triangular carriage 22, which is mounted for pivoting about a horizontal axis 24. The carriage 22 has, at right angles to its own plane, an internally-threaded nut 26 in which is threadedly received a lead screw 28. The lead screw 28 can be rotated about its own longitudinal axis by means of a suitable conventional motor 30, which can, for example, be a small ordinary electric motor or a stepper motor. By rotating the lead screw 28, the angular position of the carriage 22 about its pivot axis 24 is varied.

According to the invention, the angular position of the lead screw 28 is varied, either continuously or from time to time, to pivot the carriage 22 in a clockwise direction (as seen in the figure), so as to maintain the slitter knife 16 in engagement with the whetters 20 with a more or less constant pressure. The whetter discs 20, the drum 12 and the carriage 22 are designed and located so that, when the knife edge engages the whetter discs 20 with the proper pressure to be sharpened, the edge is also properly located relative to the drum 12 to cut the workpiece in the desired manner. A unit 32 is provided to control the motion of the carriage 22. The control unit 32 can, for example, be a simple timer which causes the motor 30 to rotate the lead screw 28 in such a manner as to pivot the carriage 22 at an approximately constant angular velocity. Alternatively, the control unit 32 can use a timer in conjunction with other circuitry to operate a stepping motor to pivot the carriage 22 periodically in small predetermined steps.

Alternatively, a photocell or other known device can be used to monitor the position of the cutting edge of the knife 16. In this case, control unit 32 adjusts the position of the carriage 22 as a function of an electrical signal output by the photocell.

A more sophisticated version uses a microprocessor as the control unit 32, permitting the angular position of the carriage 22 to be varied in a more complex way, for example, as a function of the observed value of some parameter. For example, a system can be provided to monitor the sharpness of the slitter knife 16, and to produce an electrical signal to be analyzed by the microprocessor for use in determining when a change in the pivotal position of the carriage 22 is appropriate.

From the foregoing description, it will be clear that as the slitter knife 16 becomes dull through use, the arrangement of the invention causes the knife 16 to be resharpened by the whetters 20. The pivotal motion of the carriage 22 which maintains the slitter knife 16 in engagement with the whetters 20 also, as can be seen from the figure, shortens the distance between the rotational axes of the slitter knife 16 and the cigarette drum 12. This ensures that the cigarettes are fully severed despite the decrease in the diameter of the slitter knife 16 due to the whetting process.

If desired, the whetting device 20 can also be moved or urged toward the knife 16 to aid in maintaining the desired engagement between the whetters 20 and the knife 16. Means for doing so is indicated schematically and in phantom at 34.

Because the distance between drum 12 and the slitter knife shaft 18 decreases with knife usage, the depth of the knife 16 is maintained below the groove 14 in drum 12 and thus extends the knife life. With conventional apparatus, once the knife diameter decreased to a point when where it was no longer below the bottom of the groove in the drum, the knife would have to be replaced.

The present invention can also be used, with modifications that will be apparent to those skilled in the art, to cut an annular groove in a rod-shaped article. In this case, use of the invention prevents the knife 16 from becoming dull while advancing the knife at the proper rate to keep the depth of the grooves that it is cutting constant.

Although the present invention has been particularly described with respect to one preferred embodiment thereof, many variations and modifications thereof will now be apparent to those skilled in the art. Accordingly, the scope of the invention is to be limited not by the details of the described embodiment, but only by the terms of the appended claims.

What is claimed is:

1. An apparatus for cutting a rod-shaped article such as a tobacco rod or a filter plug rod, said apparatus comprising:

a rotatable slitter knife;

means for supporting a rod-shaped article at a predetermined position to be cut by said slitter knife;

whetter means adjacent said slitter knife for whetting said slitter disc while said slitter knife rotates; and adjustment means for automatically adjusting the position of said slitter knife to maintain it in whetting engagement with said whetter means.

2. The apparatus of claim 1, wherein said adjustment means comprises a carriage supporting said slitter knife and pivotable about a predetermined axis to control the interference between said slitter knife and said whetter means, means for pivoting said carriage about said axis, and control means for controlling said pivoting means to control said interference.

3. The apparatus of claim 2, wherein said control means comprises timer means for causing said pivoting means to pivot said carriage about said axis at an approximately constant rate to maintain said whetting engagement.

4. The apparatus of claim 2, wherein said control means comprises microprocessor means.

5. The apparatus of claim 2, wherein said control means comprises timer means for causing said pivoting means to pivot said carriage about said axis in steps.

6. The apparatus of claim 1, further comprising second adjustment means for advancing said whetter means to aid in maintaining said whetter means and said slitter disc in whetting engagement.

7. A method for cutting rod-shaped articles such as filter plug rods, comprising the steps of supporting a rod-shaped article at a predetermined position to be cut, rotating a knife to cut said article supported at said predetermined position, and maintaining said knife in whetting engagement with a whetting device to keep said knife sharp, by means of moving said knife toward said whetting device and toward said predetermined position to maintain said whetting engagement as said knife cuts.

8. The method of claim 7, wherein said maintaining step comprises pivoting said knife about a predetermined axis.

9. The method of claim 7, wherein said maintaining step comprises moving said knife at an approximately constant rate.

10. The method of claim 7, wherein said maintaining step comprises moving said knife in predetermined steps.

11. The method of claim 7, wherein said maintaining step further comprises moving said whetting device to aid in maintaining said whetting engagement.

12. The method of claim 7, wherein said article is supported at said predetermined position in such a manner that said knife severs said article into two pieces.

13. The method of claim 7, wherein said article is supported at said predetermined position in such a manner that said knife cuts an annular groove of predetermined length in said article without severing said article.

* * * * *